United States Patent [19]

Reineman

[11] Patent Number: 4,700,514

[45] Date of Patent: Oct. 20, 1987

[54] MONOCOQUE BUILDING SHELL

[76] Inventor: Richard G. Reineman, 601 Clubhouse Ave., Newport Beach, Calif. 92663

[21] Appl. No.: 762,424

[22] Filed: Aug. 5, 1985

[51] Int. Cl.[4] ..... E04B 1/32

[52] U.S. Cl. ..... 52/86; 52/80

[58] Field of Search ..... 52/3, 63, 80, 82, 86, 52/88, 89, 309.9

[56] References Cited

U.S. PATENT DOCUMENTS

| | | | |
|---|---|---|---|
| 2,690,185 | 9/1954 | Pomyhala | 52/81 X |
| 3,530,623 | 9/1970 | Burton | 52/86 |
| 3,535,836 | 10/1970 | Blashi | 52/86 X |
| 3,750,353 | 8/1973 | Smith, Jr. | 52/86 X |
| 3,763,608 | 10/1973 | Chamlee | 52/82 X |
| 3,984,950 | 10/1976 | Hildebrand et al. | 52/80 X |
| 4,094,110 | 6/1978 | Dickens et al. | 52/88 X |
| 4,125,972 | 11/1978 | Pate | 52/309.9 X |
| 4,211,504 | 7/1980 | Sivachenko | 52/86 X |

FOREIGN PATENT DOCUMENTS

| | | | |
|---|---|---|---|
| 638997 | 2/1964 | Belgium | 52/86 |
| 676445 | of 1963 | Canada | 52/80 |
| 711287 | 6/1954 | United Kingdom | 52/80 |

*Primary Examiner*—William F. Pate, III
*Assistant Examiner*—Creighton Smith
*Attorney, Agent, or Firm*—Frank C. Price

[57] ABSTRACT

A monocoque building shell is made up of multiple sections of a compound curved shape. Along the axial length of the building the walls and roof are madeup of a repeated smooth wave form, the amplitude of the wave being in proportion to the stresses generated in the shell as a function of its weight and shape and assumed loads such as snow. In the transverse direction the roof is an hyperbolic shape from the roof center to the corner where the shape curves downward into vertical walls. The wall construction is of insulative foam in a sandwich between inner and outer skins of fiberglass.

5 Claims, 6 Drawing Figures

A-A

C-C

B-B

A
B
C
1
2
3
5
6
7
8
9
10
11
12
13
14
15
16

MONOCOQUE BUILDING SHELL

References cited in filing of the Patent
U.S. Pat. No. 2,690,185; Pomykala; Sep. 28, 1954
U.S. Pat. No. 3,535,836; Blaski; Oct. 27, 1970
U.S. Pat. No. Des. 171,889; Graham; Apr. 6, 1954
U.S. Pat. No. Des. 137,387; Pitou; Feb. 29, 1944
U.S. Pat. No. 3,763,608; Chamlee; Oct. 9, 1973

BACKGROUND

1. Field of the Invention

The field of this invention encompasses prefabricated buildings made of one monocoque shell. The shell thus functions both as the enclosure walls and roof and as the structure of strength without other internal or external supports to hold up the walls or support the roof. The open interior volume is often used for storage. Also, since the preferred embodiment of this invention uses a shell made as a sandwich of insulative foam bonded to inner and outer skins of fiberglass, the invention thus encompasses buildings, wherein control of the internal environment is maintained, such as in very cold regions of the earth or simply where the stored material must be protected from temperature extremes and/or be gas tight.

2. Description of the Related Art

Pomykala has invented an all-weather hut, circular in shape. However, the strength elements consist of a framework of tubes, ribs and stressing cables.

The prefabricated building concept of Blaski contains a plurality of sheetmetal panels having curvatures in two directions transverse to each other. The sides and roof are formed with the same radius and of frusto-conical configuration. The roof and the sidewalls are fabricated separately and then joined as two separate, sharply-intersecting arcs with the upper edges of the walls engaging the underside of the roof with suitable securing. Cross ties form a third basic element of the construction to balance the outwardly directed forces of the building construction. The sidewalls and roof are prefabricated separately and then joined for erection of the building. Flanges for joining walls and roof are fundamental to the concept.

P. Graham has a design patent for a building, part of which includes simple hyperbolic arch elements which are also arched in the transverse direction. The transverse arches intersect in a curved line, also a hyperbola. The intersection appears as a deep "V" with the intersection line being the apex of the "V". The method of joining at the "V" is not described. The hyperbolic arch elements form sloping walls. The design of E. Pitou is similar.

Chamlee's patent covers a dome-shaped shelter comprised of a plurality of spherical segments forming a self-supporting structure. The individual panels are constructed of a composite sandwich of foam and bonded fiberglass.

SUMMARY OF THE INVENTION

This is the invention of a monocoque form of building, that is, with the walls and roof of the building being self-containing of the structural strength of the building. There are no separate structural elements. The structure forms the ceiling and vertical sides all in one form. Two vertical planes sliced through the two side walls and the roof of the shell comprise one element of the building which can be made, with repeating elements, of any desired length.

A single element of the shell, or monocoque, is a portion of a continuously undulating, smooth wave corrigation along the direction of the axis of the space to be enclosed and it includes, in the transverse section, a curved or flat form for the roof which blends in a curve into the sidewall down to the floor. The wave corrigation is maintained around the blending, upper-corner region and on down the vertical wall. The amplitude of the wave is maximum at the outer shoulder of the hyperbola, which is the blending upper corner region. The wave amplitude tapers to a minimum at the floor while the taper towards the center of the roof is only moderate. This moderate taper serves to allow adequate section modulus at the center of the roof to support roof loads of people or snow.

With the amplitude of the wave being at its maximum along the roof/wall corner, the blending strength in this corner is maximum, corresponding to the maximum bending load which occurs in this region. A hyperbolic form can be used in the transverse section of the overhead in order to minimize roof bending stresses or the shape may be flat and horizontal or slanted.

This concept of a building is especially applicable to storage use, the internal shape allowing high efficiency of use of the internal volume. The elements which compose the shell can readily be made in pre-fabrication. The shell can be made of a sandwich of insulative foam and fiberglass skins, a lightweight construction with excellent heat insulation characteristics.

DESCRIPTION OF THE PREFERRED EMBODIMENT

While the invention is described in specific terms for a given size of building which is shaped in given curves, with thicknesses of cross section and with specific materials of construction, no intention is made to limit the invention to such detail.

Figures 1, 2, 3, 4, 5:
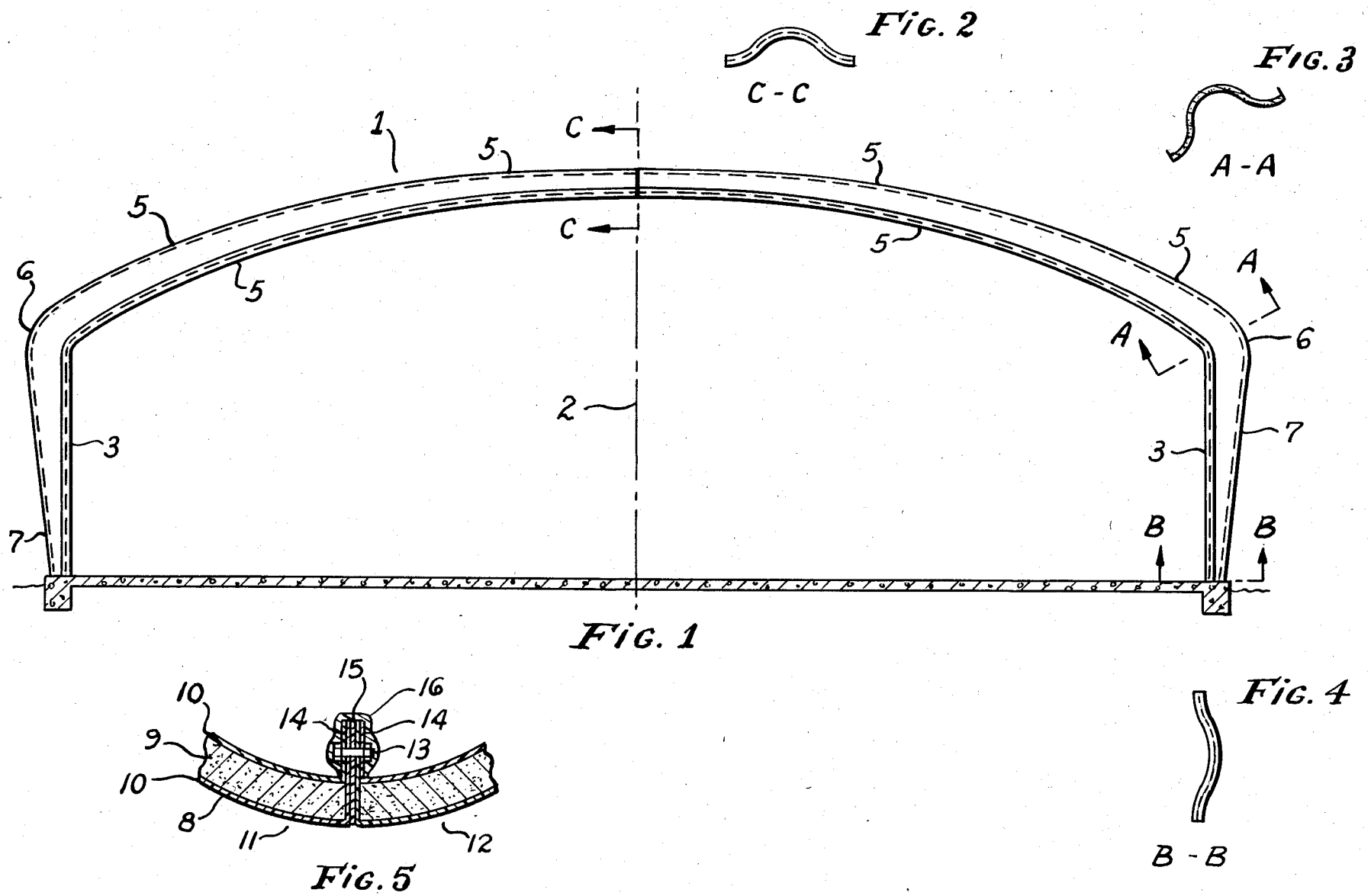
FIG. 1 is a cross-sectional view of the monocoque shell taken perpendicular to the axis of the building.
FIG. 2 is a cross-sectional view taken along the axis of the building shell at the center of the roof.
FIG. 3 is a cross-sectional view taken along the axis of the building shell at the corner region of the shell where the roof turns down and the side wall begins.
FIG. 4 is a cross-sectional view taken along the axis of the building shell at the bottom of the sidewall.
FIG. 5 is a cross-sectional view illustrating the wall construction details and the joints between repeated sections which together form the length of the shell.

Referring now to the drawings, FIG. 1 describes the invention of the building shell 1 as seen in a cross-section taken perpendicular to the axial plane 2 of the shell 1 which divides it vertically into two similar halves. The important detail of FIG. 1 is the hyperbolic shape of the roof portion 5, the smooth, tight curve at the corners 6 where the roof blends into the exterior side wall 7 and the vertical interior side walls 3.

In order to describe more fully the view of FIG. 1, FIGS. 2, 3 and 4 are presented as cross-sectional views taken by planes perpendicular to the shell at three places. Each of the FIGS.—2, 3, and 4 limits its view to one full wave, the shell consisting of repeated full wave forms for the total axial length of the building. In this embodiment a parabolic wave is used with the amplitude being maximum at the roof/wall corner, FIG. 3, then tapering, as seen in FIG. 1, to a lesser amplitude at the center of the roof, FIG. 2, and nearly vanishing in amplitude at the floor/wall intersection, as seen in FIG. 4. The amplitudes of the parabolic wave along the shell, from floor to corner to roof center, vary to create a section moduli in proportion to the moments created by the structure shape and weight plus the assumed loadings, such as people or snow.

A wide range of wave amplitudes is possible. The wave amplitudes at the roof center and at the side wall bottom, ratioed to the maximum amplitude at the corner 6, can be in the ranges of 10 percent to 50 percent and 3 percent to 10 percent, respectively.

FIG. 5 shows the detail of the building shell 1 cross section including one possible form of joint for connecting two elements or modules. There are many other means for joining two elements, as one skilled in the art could design. The flange approach shown is not intended as the only means for joining. The wall 8 throughout the shell, either as roof 5, corner 6 or side wall 7 is made up of urethane insulative foam 9 bonded to inner and outer skins 10 of glass fiber reinforced resin. Two sectional elements 11 and 12 of the total shell 1 are joined by rivets or rods 13 at flanges 14, sealed by polysulfide spacer 15, all covered by fiberglass weather seal 16.

Figure 6:
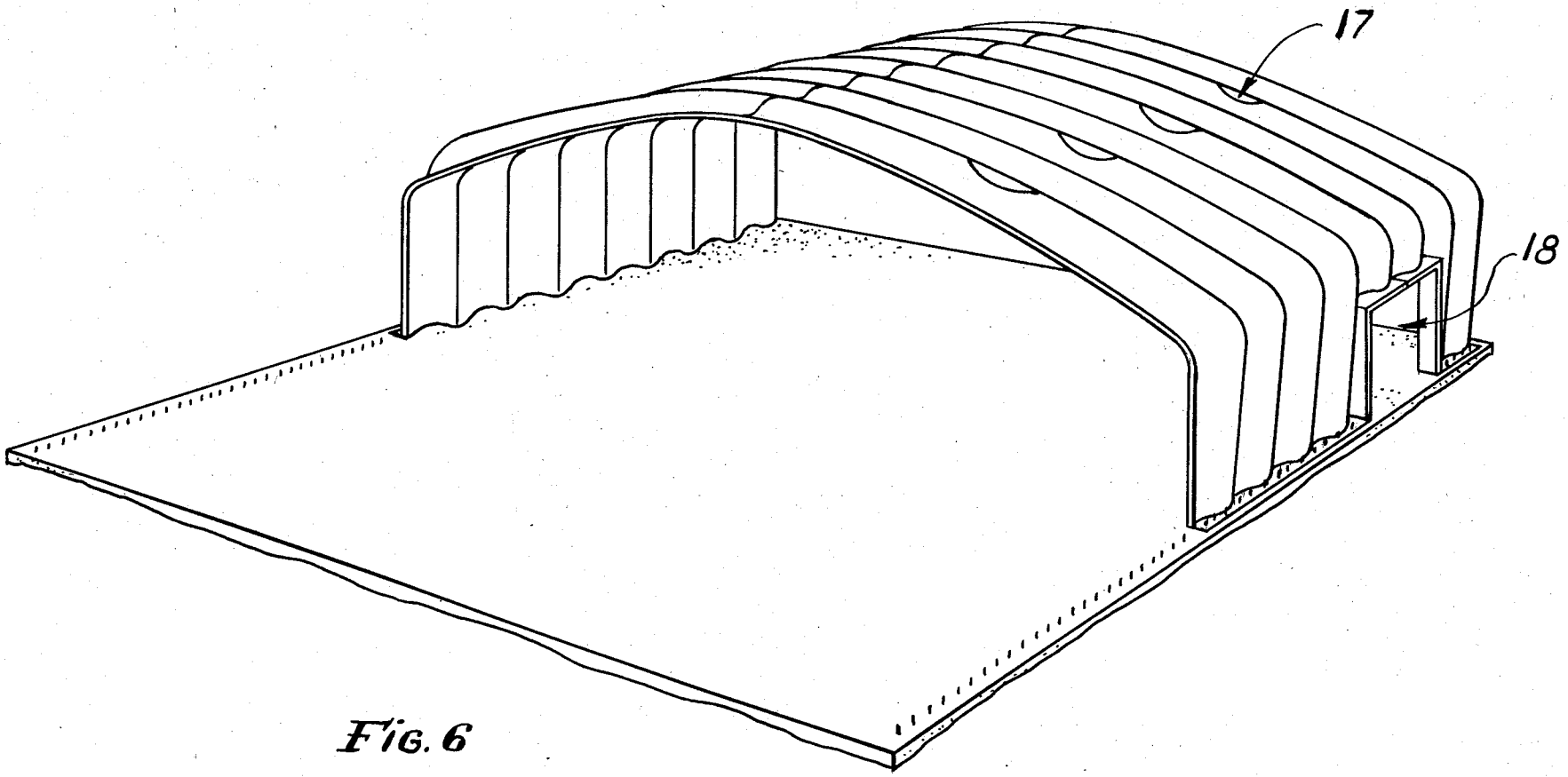
FIG. 6 is an isometric view which shows how a door might be inserted. The joint details are omitted. Roof openings are shown.

FIG. 6 shows in isometric viewing, without joint details, the concept of roof openings 17. These could function to fit skylights or vents which could be molded in place during layup of the repeated modules. Similarly, the door opening 18 could readily be installed in a properly-sized cutout of the molded, prefabricated modules.

While the invention can be demonstrated in buildings of various span/height combinations, one example would be a span of 100 feet using single sine wave modules 10 feet long, shell thickness of 3½ inches, and parabolic wave anplitudes at the roof center, corner and floor of 2 feet—3 inches, 3 feet—nine inches, and 12 inches respectively, with gradual transitions of amplitude in between these points. The wall height can be 10 to 20 feet. The height to the center of the roof would be 10 feet more than the side wall height to where the corner begins.

Since the compound-curved shell is structually forgiving, large openings can be inserted in the shell for doors, windows and skylights. The end closures for the building can be made of vertical straight walls made of the same composition as the main building shell.

I claim:

1. A monocoque building shell of a given axial length formed by repeated elements adjoining along the axial length of the building, including roof and sidewall portions, composed of a compound curvature, a single, continuous curve in the transverse direction and a repeating curve in the axial direction, and all similar about an axial plane midway between the building sidewalls, the improvement comprising:

the shell made up of a continuous undulating wall of smooth wave-shaped form, the wave proceeding in its undulation in the direction of the building axis, the amplitude and cycle length of the waves being defineable by cross sections through the shell made by planes parallel to the building axis, the amplitude of the waves being variable in the cross sections which are made proceeding along the shell from the roof center to the bottom of the side walls, the amplitude at a given position being in direct proportion to the sum of all stressing moments determined to be imposed at the given position.

2. The monocoque building shell of claim 1 wherein the shell from its center outward, seen in cross section perpendicular to the building axis, is a smooth curve with its smallest radius of curvature forming a corner, the curvature becoming tangent to the vertical as it proceeds to the ground level.

3. The monocoque building shell of claim 1 wherein the amplitude of the wave form is maximum at the corner, at the ground between three and ten percent of the amplitude at the corner and at the roof center between 10 percent and 50 percent of the amplitude at the corner.

4. The monocoque building shell of claim 1 wherein the vertical walls are vertical on the building interior, the taper of the amplitude forming a slant to the walls on the building exterior.

5. The monocoque building shell of claim 1 wherein the wave form is a parabolic wave.

* * * * *